US005291165A

United States Patent [19]

Whipple et al.

[11] Patent Number: 5,291,165

[45] Date of Patent: Mar. 1, 1994

[54] INSULATING BARRIERS FOR CIRCUIT BREAKER BUS BARS AND A GROUND FAULT CIRCUIT BREAKER INCORPORATING SAME

[75] Inventors: Michael J. Whipple, New Sewickley; Joseph P. Fello, Penn Hills Township, Allegheny County, both of Pa.

[73] Assignee: Westinghouse Electric Corp., Pittsburgh, Pa.

[21] Appl. No.: 943,796

[22] Filed: Sep. 11, 1992

[51] Int. Cl.[5] ..... H01H 73/00

[52] U.S. Cl. ..... 335/18; 361/637

[58] Field of Search ..... 335/18, 23-25, 335/35; 361/42-48, 355, 361, 358, 363

[56] References Cited

U.S. PATENT DOCUMENTS

| | | | |
|---|---|---|---|
| 3,566,318 | 12/1968 | Gelzheiser et al. . | |
| 3,611,048 | 10/1971 | Shelvik | 335/18 |
| 3,931,601 | 1/1976 | Anderson | 335/18 |
| 4,081,852 | 3/1978 | Coley et al. . | |
| 4,199,655 | 4/1980 | Shariff et al. | 361/341 |
| 4,631,634 | 12/1986 | Raabe et al. | 361/358 |
| 5,046,173 | 9/1991 | Wall, Jr. | 361/353 |
| 5,179,491 | 1/1993 | Runyan | 361/361 |

*Primary Examiner*—Lincoln Donovan
*Attorney, Agent, or Firm*—M. J. Moran

[57] ABSTRACT

Insulating barriers for flat, confronting C-shaped bus bars with facing, depending end portions are integrally formed with a pair of confronting C-shaped insulating members conforming to the shape of the bus bars and joined by a pair of projections extending between and electrically insulating the facing, depending end portions from each other. Preferably, the insulating barrier is formed with flat linear sections joining the confronting C-shaped members which are then folded to form the projections. The C-shaped insulating members have edge extensions covering the edges of the bus bars. Grippers formed integrally with the edge extensions snap under the bus bars to secure the insulating members in place.

12 Claims, 5 Drawing Sheets

INSULATING BARRIERS FOR CIRCUIT BREAKER BUS BARS AND A GROUND FAULT CIRCUIT BREAKER INCORPORATING SAME

CROSS REFERENCE TO RELATED APPLICATIONS

U.S. patent application Ser No. 07/676,150, filed on Mar. 27, 1991 and entitled DUAL WOUND TRIP SOLENOID.

Commonly owned U.S. patent application filed on Sep. 11, 1992, having U.S. Ser. No. 943,803, and entitled CIRCUIT BREAKER WITH AUXILIARY SWITCH ACTUATED BY CASCADED ACTUATING MEMBERS concurrently filed in the names of Joseph P. Fello and Michael J. Whipple; U.S. patent application filed on Sep. 11, 1992, having U.S. Ser. No. 07/943,670, and entitled GROUND FAULT CIRCUIT BREAKER WITH FLAT BUS BARS FOR SENSING COILS concurrently filed in the names of Joseph Joseph P. Fello, William E. Smith, Wilbert E. Lindsay and Michael J. Whipple; and U.S. patent application filed on Sep. 11, 1992, having U.S. Ser. No. 07/943,801, and entitled GROUND FAULT CIRCUIT BREAKER WITH TEST SPRING/CONTACTS DIRECTLY MOUNTED TO TEST CIRCUIT OF PRINTED CIRCUIT BOARD concurrently filed in the names of Joseph P. Fello, Michael J. Whipple, Umesh C. Patel and Garry B. Theadore.

BACKGROUND OF THE INVENTION

1. Field of the Invention

This invention relates to ground fault circuit breakers with flat bus bars extending through toroidal ground fault sensing coils, and to insulating barriers for such bus bars.

2. Background Information

There is a growing demand today for circuit breakers for residential and light industrial and commercial use which provide ground fault protection. An example of such a circuit breaker is disclosed in commonly owned U.S. patent application No. 676,150, filed on Mar. 27, 1991. The ground fault detector in this circuit breaker utilizes two toroidal coils as transformers laterally spaced from one another. Both the line and neutral conductors are passed through the toroidal coils to form the primaries of the two transformers. A test lead also passes through one of the toroidal coils.

These residential and light commercial and industrial circuit breakers are designed for installation and standardized load centers and panel boards, and therefore, the space available within the circuit breaker having for the ground fault detector is limited. In order to increase the rated capacity of such circuit breakers provided with ground fault protection, commonly owned, concurrently filed U.S. Patent Application entitled Ground Fault Circuit Breaker with Flat Bus Bars for Sensing Coils, Ser. No. 07/943,801, discloses the use of flat bus bars as the line and neutral conductors passing through the toroidal coils. This co-pending application proposes insulating the bus bars from each other and from other components in the circuit breaker by coating the bus bars with an air dry insulating enamel.

SUMMARY OF THE INVENTION

It is an object of the present invention to provide improved residential light industrial and commercial circuit breakers with ground fault protection having improved means for insulating the bus bars in the ground fault detector.

It is also an object of the invention to provide such improved insulating means which can be easily and economically installed and retained in place.

These objects and others are realized by the invention which is directed to an insulating barrier for a pair of confronting flat C-shaped circuit breaker bus bars with facing depending end portions wherein the barrier comprises a pair of confronting C-shaped insulating members conforming to the shape of the flat C-shaped bus bars and joined by a pair of projections which extend between and electrically insulate the facing depending end portions of the bus bars from each other. Preferably, the insulating barrier is formed with flat linear sections joining the confronting C-shaped members which are then folded to form the projections. The C-shaped insulating members have edge extensions covering the edges of the bus bars. Grippers formed integrally with the edge extensions snap under the bus bars to secure the insulating member in place.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be shown as applied to a single pole residential or light commercial or industrial ground fault circuit breaker; however, it will be evident to those skilled in the art that the invention is also applicable to multi-pole circuit breakers as well.

Figure 1:
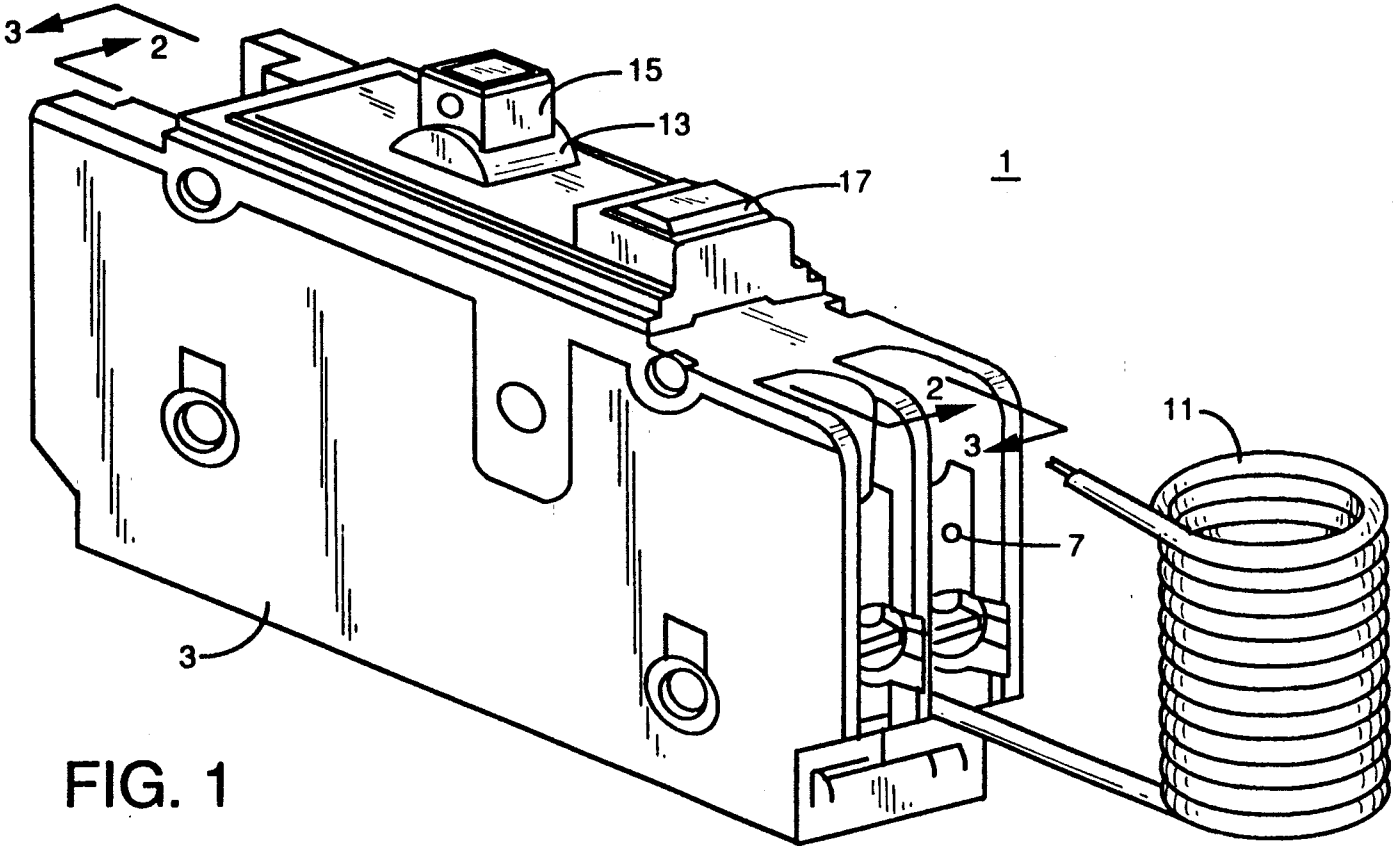
FIG. 1 is an isometric view of a ground fault circuit breaker to which the invention has been applied.

Referring to FIG. 1, the ground fault circuit breaker 1 comprises a housing 3 which is composed of electrically insulating material such a thermo-setting resin. A load terminal 5 and load neutral terminal 7 are provided for connecting the circuit breaker to a load. A line terminal 9 (see FIG. 2) is provided at the opposite end of the housing 3 for connection to a commercial power system. The line side of the neutral is connected to a pigtail 11. The ground fault circuit breaker 1 includes an operating member 13 having an integral molded handle 15 extending through the housing 3. A ground fault test switch 17 is also accessible through the housing.

Figure 2:
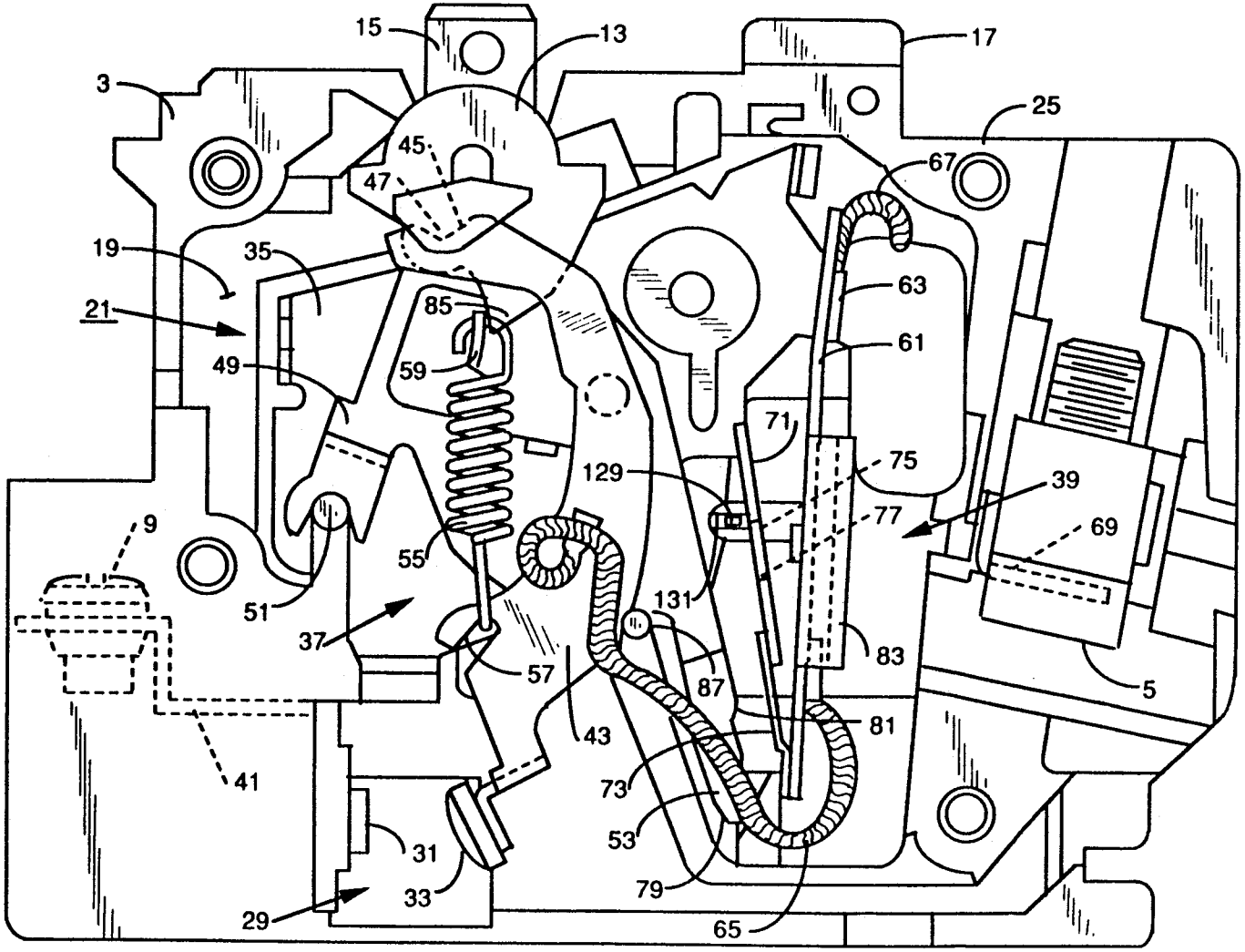
FIG. 2 is a vertical section taken along the line 2—2 through the circuit breaker of FIG. 1.
Figure 3:
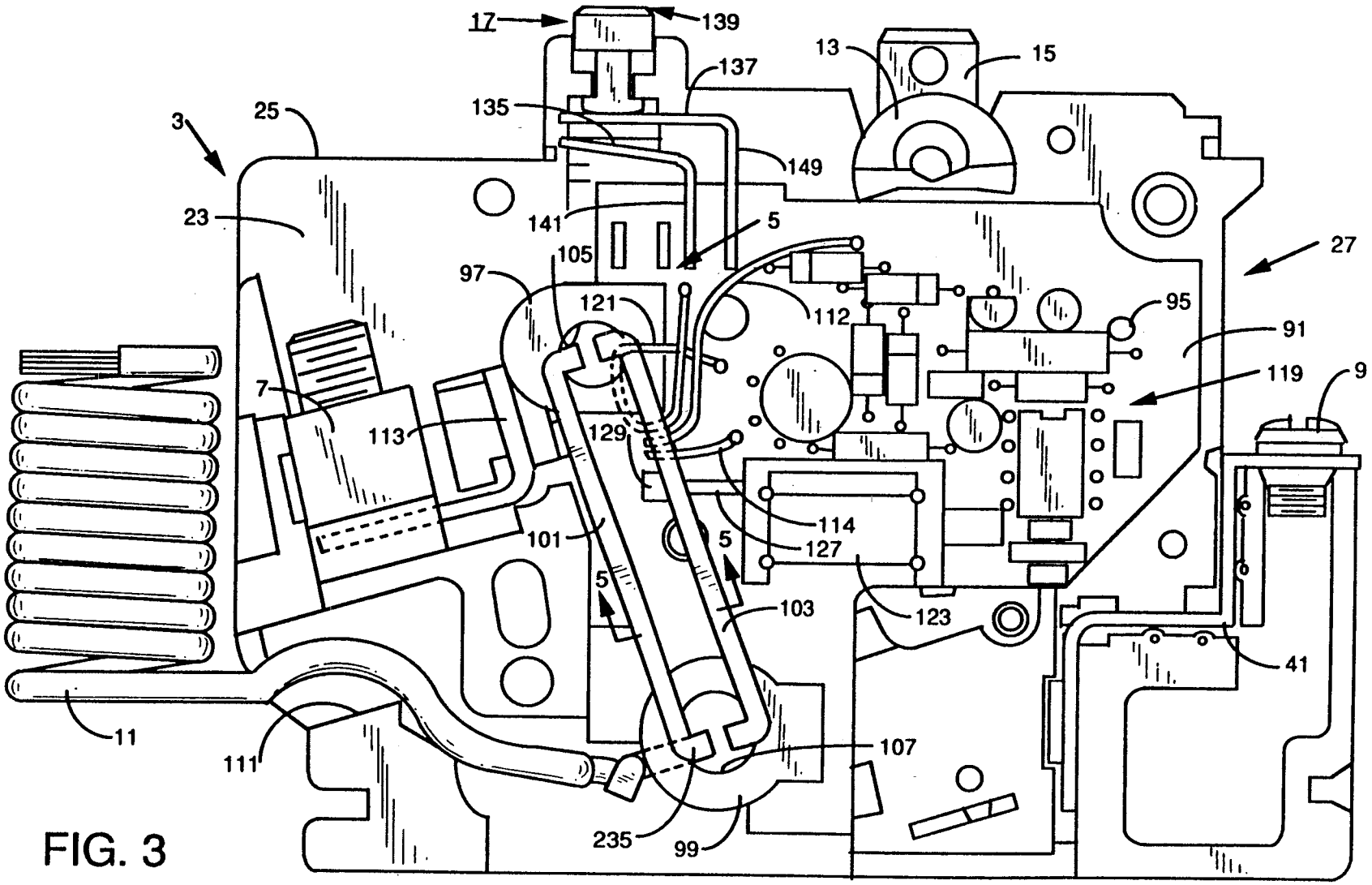
FIG. 3 is another vertical section through the circuit breaker of FIG. 1 taken along line 3—3.

The housing 3 defines a compartment 19 (see FIG. 2) in which a circuit breaker mechanism 21 is housed, and a second compartment 23, separated from the compartment 19 by a center panel 25, which houses a ground fault circuit interrupter 27 (see FIG. 3).

The circuit breaker mechanism 21 is of the type disclosed in U.S. Pat. No. 3,566,318 which is hereby incorporated by reference for a complete description of the structure and its operation. Briefly, the circuit breaker mechanism 21 includes a pair of separable contacts 29, including a fixed contact 31 and a movable contact 33, a supporting metal frame 35, an operating mechanism 37, and a trip device 39. The fixed contact 31 is connected by a conductor 41 to the line terminal 9.

The operating mechanism 33 includes a flat electrically conductive generally C-shaped contact arm 43 to which the movable contact 33 is secured at the lower end. The upper end of the contact arm has a notch 45 which is biased against a projection 47 on the operating member 13 in a manner to be discussed. The operating member is mounted in the housing 3 for rotation about an axis perpendicular to the plane of FIG. 2. Motion is transmitted from the operating member 13 to the contact arm 43 when the circuit breaker 1 is manually operated, and from the contact arm 43 to the operating member 13 when the breaker is automatically tripped.

The operating mechanism 37 further includes a latchable cradle 49 which is pivotally supported at one end by a pivot 51 molded into the center panel 25. The other end 53 of the cradle 49 is latched by the trip device 39 in a manner to be discussed.

As more specifically described in U.S. Pat. No. 3,254,176, the ends of the latchable cradle 49 are offset and disposed along a plane which is parallel to a plane in which the main body portion of the latchable cradle 49 is disposed. This places the ends of the cradle 49 in the same plane as the C-shaped contact arm 43. A spring 55 is connected, under tension, at one end in a slot 57 near the lower end of the C-shaped contact arm 43, and at the other end to a bent over tab 59 projecting outward from the main body of the latchable cradle 49.

The trip device 39 includes a bimetal 61 secured at an upper end to a bent over tab 63 on the frame 35. The contact arm 43 of the operating mechanism 37 is connected to the lower end of the bimetal 61 by a flexible conductor 65. The upper end of the bimetal 61 is connected by another flexible conductor 67 to the ground fault detector discussed below which in turn is connected to a tang 69 extending through an opening in the end wall of the housing 3. The load terminal 5 is connected to the external end of the tang 69 for connection of the circuit breaker to a load. The closed circuit through the circuit breaker 1 extends from the line terminal 9, conductor 41, fixed contact 31, movable contact 33, contact arm 43, flexible conductor 65, bimetal 61, flexible conductor 67, the ground fault detector, tang 69, and load terminal 5.

The trip device 39 further includes an elongated, rigid magnetic armature or latch member 71 mounted on a spring 73 which is welded to the free lower end of the bimetal 61. The magnetic armature 71 extends generally upward along side the bimetal 61, and has an opening 75 forming a latch surface 77 at the base of the opening. The latch end 53 of the cradle 49 is formed with a latch surface 79 and a stop surface or fulcrum part 81. The armature 71 serves as a stop to engage the fulcrum part 81 of the latchable cradle 49 in the latched position of the cradle. A U-shaped magnetic member 83 is secured to the bimetal 61 adjacent the magnetic armature 71 to concentrate the flux created by current flowing through the bimetal.

The circuit breaker is shown in FIG. 2 in the tripped position. The cradle 49 is latched for resetting the circuit breaker by rotating the handle 15 clockwise, as shown in FIG. 2. This causes a projection 85 on the operating member 13 to engage the tab 59 and rotate the latchable cradle 49 in the counterclockwise direction until the latch end 53 is latched in the opening 75 in the magnetic armature 71. This operation is shown in detail in U.S. Pat. No. 3,566,318.

The separable contacts 29 are closed by moving the handle 15, with the cradle 49 latched, in the counterclockwise direction as viewed in FIG. 2 to the on position. This causes the projection 47 on the operating member 13 which engages the notch 45 in the contact arm 43 to move the upper end of the contact arm to the right of the line of action of the spring 55 resulting in closure of the contacts 29. The contacts 29 could be manually opened from this closed position by rotating the handle 15 clockwise, as viewed in FIG. 2, to the off position.

The trip device 39 provides over-current protection through the bimetal 61. Prolonged current above the rated current of the circuit breaker heats the bimetal 61 causing the lower end to deflect to the right, as shown in FIG. 2, thereby unlatching the cradle 49, as the armature 71 pivots about the fulcrum 81 until the latch surface 79 on the latch end 53 of the cradle slides off of the latch surface 77. When unlatched, the cradle 49 is rotated clockwise by the spring 55 until it engages a stop pin 87 molded in the center panel 25 of the circuit breaker housing. During this movement, the line of action of the spring 55 moves to the right of the pivot formed by the notch 45 in the contact arm and the projection 47 on the operating member 13, whereupon the spring 55 biases the contact arm 43 in the opening direction to open the contacts 29 and moves the contact arm 43 so that the line of action of the force exerted by the spring on the operating member 13 shifts across the rotational axis of the operating member 13 and actuates the operating member to the tripped position shown in FIG. 2. The tripped position of the operating member 13 is intermediate the "on" and "off" positions. The operating member 13 is stopped in the intermediate or tripped position seen in FIG. 2 when the projection 85 engages the tab 59 on the cradle 49. The contact arm 43 is stopped in the open position seen in FIG. 2 when it engages the stop pin 87. The circuit breaker is reset following the trip in the manner discussed above.

The trip device 39 also provides short circuit protection. The very high current through the bimetal 61 produced by a short circuit induces a magnetic flux which is concentrated by the magnetic member 83 and of sufficient magnitude to attract the armature 71 to the magnetic member, thereby unlatching the cradle 49 to trip the circuit breaker.

As discussed, the circuit breaker 1 also provides ground fault protection, both for line to ground faults and neutral to ground faults. All the components for ground fault protection are mounted on a printed circuit board 91 in the compartment 23 formed in the molded housing 3 as shown in FIG. 3. The printed circuit board 91 is positioned within the compartment 23 by a pin 95 molded into the center panel 25. A suitable ground fault protection circuit 119 is the well-known dormant oscillator-type such as disclosed in U.S. patent application Ser. No. 676,150 referred to above. This circuit includes two transformers formed by toroidal sensing coils 97 and 99. The primaries of the transformers are formed by passing a neutral conductor 101 and a line conductor 103 through the central openings 105 and 107 in the sensing coils 97 and 99, respectively.

Figure 4:
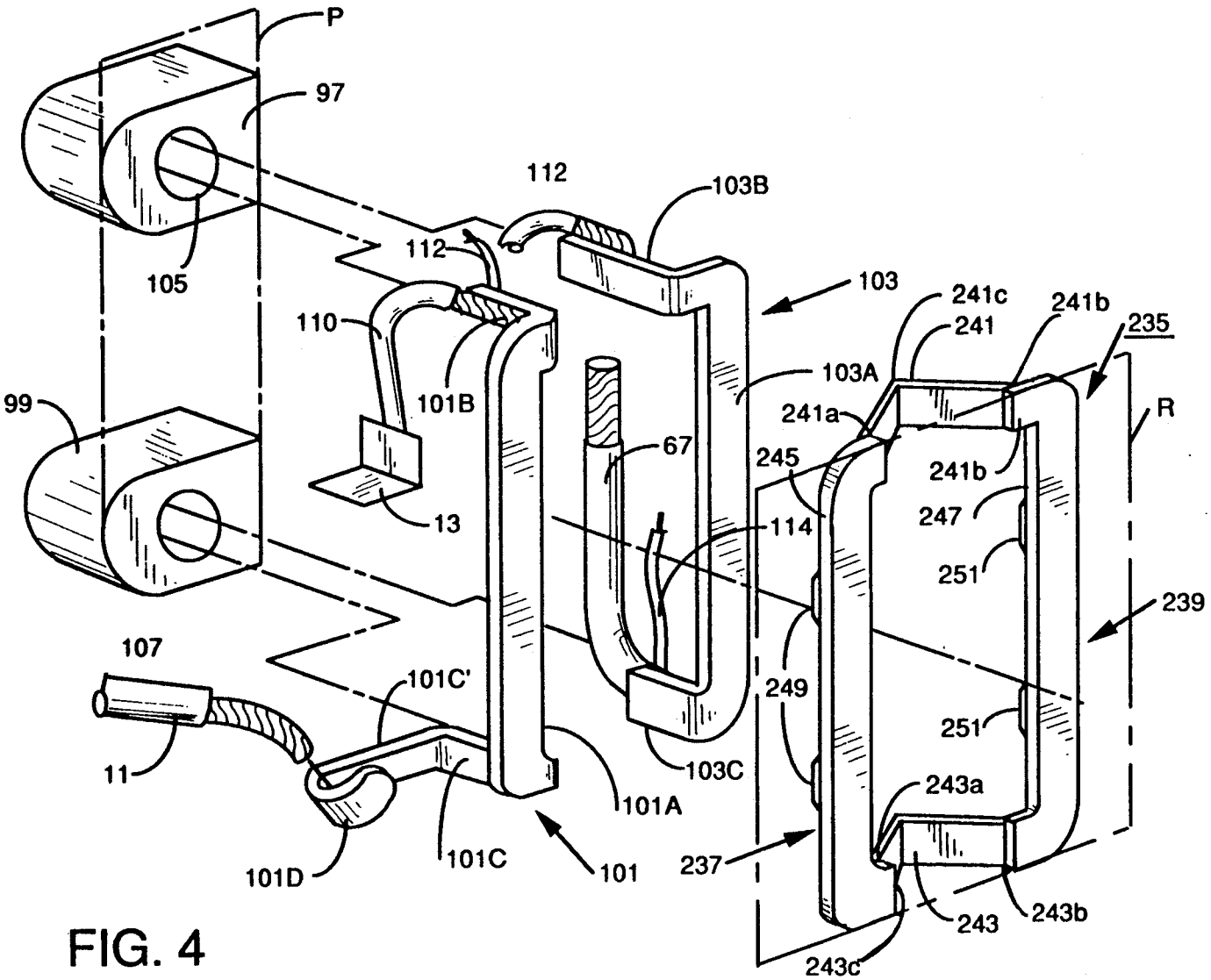
FIG. 4 is an exploded isometric view of the insulating barrier in accordance with the invention and showing the relationship of the barrier to other components of the circuit breaker.

These conductors 101 and 103 are flat bus bars formed from sheet material. As best seen in FIG. 4, the neutral bus bar 101 has a flat center section 101*a* extending parallel to a common plane P containing the end faces of the toroidal coils 97 and 99. A flat leg section 101*b* extends generally laterally from the upper end of the center section of 101*a* and is bent substantially at a right angle to the flat center section. A second leg section 101*c* extends generally laterally from the lower end of the center section 101*a* and is bent transversely to the flat center section. A terminal portion 101*c*' of the leg 101*c* is bent generally perpendicular to the leg 101*c* to extend in a plane generally parallel to the plane of the flat center section 101*a*. A crimp 101*d* is formed in the end of the terminal portion 101*c*'. Preferably, this crimp 101*d* is bent at an angle in the plane of the terminal portion 101*c*' for a purpose to be discussed.

The line bus bar 103 also has a flat center section 103*a* and a first leg section 103*b* extending bent generally perpendicular to the plane of the center section 103*a*. A second leg section 103*c* extends laterally from and is bent generally perpendicular to the lower end of the flat center section 103*a*.

The upper legs 101*b* and 103*b* and the lower legs 101*c* and 103*c* extend from opposite sides of the respective center sections 101*a* and 103*a* of the neutral bus bar 101 and the line bus bar 103 so that when the two bus bars are placed side by side the flat upper leg sections 101*b* and 103*b*, and the flat lower leg sections 101*c* and 103*c*, are in spaced, flat confronting relation. The upper leg sections 101*b* and 103*b* extend through the central aperture 105 of the toroidal coil 97 while the leg sections 101*c* and 103*c* extend through the central aperture 107 in the toroidal coil 99.

The crimp 101*d* on the terminal portion 101*c*' of the lower leg 101*c* on the neutral bus bar 101 secures this bus bar to the neutral pigtail 11. The crimp 101*d* is bent at an angle to the terminal portion 101*c*' of the lower leg 101*c* so that the pigtail is lead directly from the crimp to the opening 111 in the housing 3. The upper leg 101*b* of the neutral conductor 101 is connected by an insulated lead 110 to a tang 113 which is secured to the load neutral terminal 7. This upper end of the neutral bus bar 101 is also connected by the lead 112 to the printed circuit board 91.

The lower end of the line bus bar 103 is connected by the flexible conductor 67 to the bimetal 61 and is also connected by a lead 114 to the printed circuit board 91. The upper end of the line bus bar 103 is connected through an opening in the central panel 23 to the tang 69 leading to the load terminal 5. The windings on the toroidal sensing coils 97 and 99 form the secondaries of the sensing transformers.

In an exemplary embodiment of the invention, the neutral bus bar 101 and line bus bar 103 are formed from copper sheet material having a thickness of 0.047 inches (1.2 mm). The center sections are 0.135 inches (3.4 mm) wide and the legs are 0.125 inches (3.175 mm) wide. With these bus bars, the circuit breaker 1 has a rated current of 50 amperes. With the prior art insulated wire used as the neutral and line conductors for the sensing transformers, the 0.220 inch (5.59 mm) diameter of the central apertures 105 and 107 of the sensing coils limit the rated current of the circuit breaker 1 to 30 amps using 10 gauge twisted wire. Thus, the bus bars 101 and 103 allow the rating of the ground fault circuit breaker to be increased without major modification to the circuit breaker structure.

The neutral and line bus bars 101 and 103 are electrically insulated from each other, and from surrounding components by a one piece insulating barrier 235. The insulating barrier 235 comprises a pair of confronting C-shaped insulating members 237 and 239 in a common plane R joined by linear sections 241 and 243. The C-shaped members 237 and 239 conform to the shape of the center portions 101*a* and 103*a* and the portions of the bent legs B and C which are in the same plane as the center sections. These C-shaped members 237 and 239 have edge extensions 245 and 247, respectively, which extend over the side edges of the conductors 101 and 103. The linear sections 241 and 243 join the C-shaped members 237 and 239 in the plane of the bottom edge extensions 245 and 247. These linear sections 241 and 243 are hinged at their connections 241A and 243A with the C-shaped member 237 and at hinge connections 241B and 243B at the connection with the C-shaped member 239. The linear sections 241 and 243 are also formed with score line 241C and 243C at their midpoints. Grippers 249 and 251 are molded into the edge extensions 245 and 247, respectively.

Figure 5:
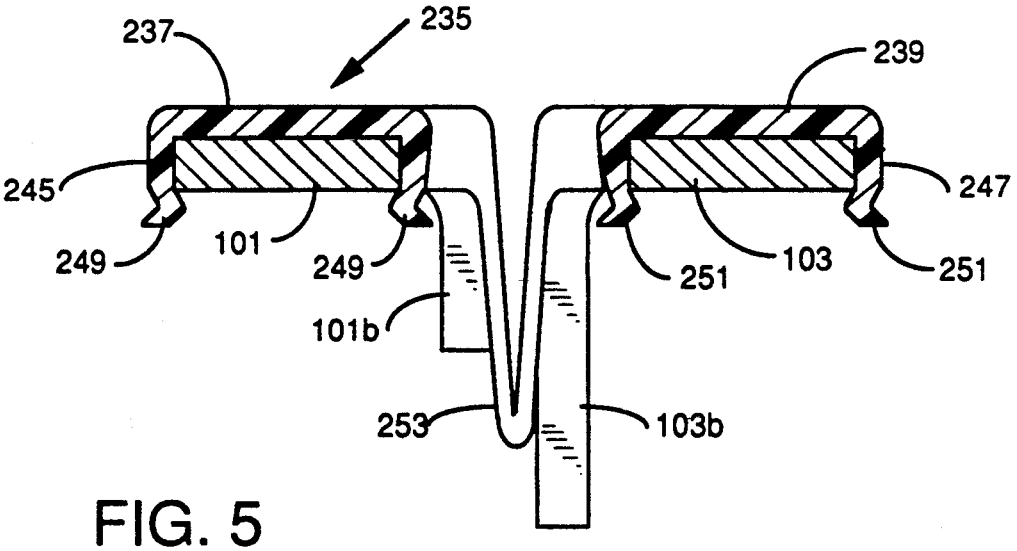
FIG. 5 is a cross section taken along the line 5-5 in FIG. 3.

The insulating barrier 235 can be formed flat in a vacuum forming process. The linear sections 241 and 243 are then folded at the hinge lines 241*a–b*, 243*a–b* and score lines 241*c* and 243*c* to form projections 253 which extend transverse to the common plane of the C-shaped members 237 and 239 as shown in FIG. 5. This also brings the C-shaped members 237 and 239 close together to the same spacing as the conductors 101 and 103. The projections 253 are then pressed between the facing depending legs 101B, 103B and 101C, 103C, respectively, with the C-shaped members 237 and 239 fitting down over the center sections 101A and 103A. The grippers 249 and 251 snap under the bottom surfaces of the conductors 101 and 103 to secure the insulating barrier 235 in place. A suitable material for the insulating barrier 235 is 0.010 inches or 0.25 thick polycarbonate.

Figure 6:
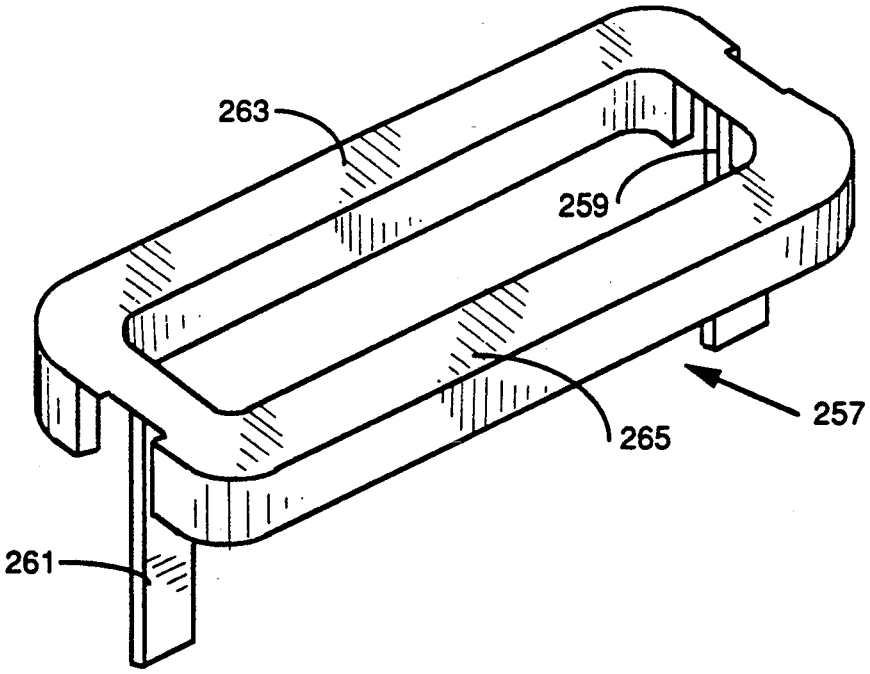
FIG. 6 is an isometric view of another embodiment of an insulating barrier in accordance with the invention.

An alternate form of the insulating barrier 257 is illustrated in FIG. 6. In this embodiment, the insulating barrier 257 is formed with the projections 259 and 261. These projections 259 and 261 space the confronting C-shaped members 263 and 265 properly to snap over the conductors 101 and 103, without folding, as in the previously described embodiment.

In operation, upon detection of a grounded load conductor or a grounded load neutral conductor through the toroids 97 or 99, the ground fault circuit 119 energizes a trip solenoid 123. Energization of the trip solenoid 123 results in extension of the solenoid plunger 127. A flag 129 secured to the plunger extends through a slot 131 in the center panel 25 and pushes the armature 71 to the right as viewed in FIG. 2 to trip the circuit breaker thereby opening the separable contacts 29.

In order to allow for periodic verification of the operation of the circuitry, a test circuit is provided which includes the test switch 17, accessible from the outside of the housing 3 as seen in FIG. 1. More specifically, a test wire 121 is connected between the neutral conductor 101 and the load conductor 103 by way of the test switch 139 of the test switch 17, which closes contacts 135 and 137, and is routed through the toroid 97 (FIG. 3) to induce a signal in the secondary winding Tl to simulate a ground fault condition. Upon actuation of the test button 139, a ground condition is simulated, resulting in a trip of the circuit breaker through energization of the trip solenoid 123.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An insulating barrier for a pair of confronting flat C-shaped bus bars with facing, depending end portions extending substantially perpendicularly to the bus bar said insulating barrier comprising:

a pair of confronting C-shaped insulating members conforming to the shape of said flat C-shaped bus bars and joined by a pair of projections which extend between and electrically insulate said facing, depending end portions.

2. The insulating barrier of claim 1 wherein said projections comprise linear sections joining said C-shaped insulating members and foldable at ends thereof and at a mid-point to project substantially transverse to a common plane of said C-shaped insulating members.

3. The insulating barrier of claim 2 wherein said linear sections are formed in substantially said common plane and folded to extend substantially transverse to said common plane.

4. The insulating barrier of claim 3 wherein said C-shaped insulating members have integral grippers along edges thereof which engage said C-shaped bus bars.

5. The insulating barrier of claim 4 wherein said C-shaped insulating members have edge extensions which extend over and insulate edges of said flat C-shaped bus bars and wherein said grippers are integrally formed with said edge extensions and engage an underside of said C-shaped bus bars.

6. The insulating barrier of claim 3 wherein said C-shaped insulating members have edge extensions which extend over and insulate edges of said flat C-shaped bus bars.

7. The insulating barrier of claim 1 wherein said C-shaped insulating members have integral grippers along edges thereof which engage said C-shaped bus bars.

8. The insulating barrier of claim 7 wherein said C-shaped insulating members have edge extensions which extend over and insulate edges of said flat C-shaped bus bars and wherein said grippers are integrally formed with said edge extensions and engage an underside of said C-shaped bar bars.

9. The insulating barrier of claim 1 wherein said C-shaped insulating members have edge extensions which extend over and insulate edges of said flat C-shaped bus bars.

10. In combination, a ground fault circuit breaker having a circuit breaker mechanism and a ground fault detector including at least one toroidal ground fault sensing coil for sensing ground faults and tripping said circuit breaker mechanism in response thereto, and further including a pair of confronting C-shaped flat bus bars with facing, depending end portions extending substantially perpendicularly to the bus bar, at least one of which from each bus bar extends through said at least one toroidal ground fault sensing coil; and an insulating barrier comprising a pair of confronting C-shaped insulating members conforming to the shape of said flat C-shaped bus bars and joined by a pair of projections which extend between and electrical insulate said facing, depending end portions.

11. The combination of claim 10 wherein said projections comprise linear sections formed substantially in a common plane with said C-shaped insulating members and foldable to project generally transverse to said common plane between said facing, depending end portions of said C-shaped bus bars.

12. The combination of claim 11 wherein said C-shaped insulating members have edge extensions which extend over and insulate edges of said flat C-shaped bus bars and grippers integrally formed with said edge extensions engaging an underside of said C-shaped bus bars.

* * * * *